United States Patent [19]

Smyth et al.

[11] Patent Number: 4,790,537

[45] Date of Patent: Dec. 13, 1988

[54] MULTI-SIZE REEL SYMBOLS

[75] Inventors: Richard E. Smyth, Kyle Bay; Daniel A. Tracy, Drummoyne, both of Australia

[73] Assignee: Ainsworth Nominees Pty. Ltd., Rosebery, Australia

[21] Appl. No.: 46,547

[22] Filed: May 6, 1987

[30] Foreign Application Priority Data

Jul. 25, 1986 [AU] Australia ..... PH07147

[51] Int. Cl.[4] ..... A63F 5/04

[52] U.S. Cl. ..... 273/143 R

[58] Field of Search ..... 273/143 R, 143 A, 143 B, 273/143 C, 143 D, 143 E

[56] References Cited

U.S. PATENT DOCUMENTS

| | | | |
|---|---|---|---|
| 4,492,379 | 1/1985 | Okada | 273/143 R |
| 4,618,150 | 10/1986 | Kimura | 273/143 R |
| 4,637,611 | 1/1987 | Hamada | 273/143 R |

FOREIGN PATENT DOCUMENTS

| | | | |
|---|---|---|---|
| 3413990 | 10/1985 | Fed. Rep. of Germany | 273/143 B |
| 2062922 | 5/1981 | United Kingdom | 273/143 R |
| 2103856 | 2/1983 | United Kingdom | 273/143 R |
| 2160345 | 12/1985 | United Kingdom | 273/143 R |

*Primary Examiner*—Carlton R. Croyle
*Assistant Examiner*—Eugene L. Szczecina, Jr.

[57] ABSTRACT

Slot machine display reels are provided with a plurality of symbols occupying differing proportions of the circumference of the reel, such that those symbols which require greater prominance occupy a larger proportion of the circumference. Associated with each reel is a spinning mechanism which is able to position any symbol on the reel centrally within an associated display window, irrespective of the size of that symbol, by taking the size of the respective symbol into account when determining the stopping position.

14 Claims, 6 Drawing Sheets

MULTI-SIZE REEL SYMBOLS

The present invention relates to gaming machines of the type known as poker machines, fruit machines or slot machines and in particular the invention relates to improvements in poker machine display reels.

Historically, symbols on a particular sized poker machine reel have always been identical in height, or more specifically the space allocated to each symbol has been equal, irrespective of the size of the symbol contained thereon. For example, the area allocated for an "orange" symbol is the same size as that for a "bar" symbol even though the picture for the bar symbol is not as high as that for the orange. In the past, the space allocated to each symbol, which is generally referred to as a "card", has been a function of the number of stops on the reel and the provision of equal spacing for each symbol has been dictated by the mechanical nature of the reel stopping mechanism. Further it has been the practice in the past to allocate one symbol for each stopping position of the reel. However, this limitation does not apply to stepper motor driven machines where the final reel position is predetermined before the spinning of the reel and where the stepping motor is able to step the reel in increments which are substantially smaller than the height allocated to each reel symbol. Also, the possibility exists in conventional machines to include symbols which occupy a space which is a multiple of the prior art symbol space or card.

The present invention consists in a reel for a poker machine display, said reel including a cylindrical peripheral surface to which a plurality of indicia are applied, each of said indicia having a symbol space within which the indicia is substantially centrally located, said symbol space occupying a proportion of the circumference of the cylindrical surface which is different for different indicia on said surface.

The provision of symbols of different sizes around the periphery of the poker machine reel allows the use of larger indicia for those reel positions which feature in larger pay outs, thereby making it easier for the player to recognise those symbols.

In the case of stepping motor driven machines, the provision of indicia of different sizes also has the additional advantage that it allows the implementation of poker machine reels on which the number of indicia is not an integral sub-multiple of the number of pulses required to step through a full revolution. For example, a stepping motor which is typically used to drive a poker machine reel will be driven through one revolution by applying 200 pulses to the motor. Therefore, if the reel is provided with 25 indicia, 8 pulses are required to step the reel by one symbol position, however, if all symbols were spaced by an equal number of pulses, it would not be possible to produce reels having 21, 22 or 23 symbols. In contrast, poker machine reels made in accordance with the present invention may have any number of symbols and the number of motor pulses associated with each symbol may be adjusted in relation to the height of the symbol, with the total for one revolution of the reel still adding up to 200 pulses.

The invention is of particular advantage in the United States where machines known as "Keno" type machines have only a few symbols spaced around the periphery of their reels with the remainder of the reels being blank. In such machines the symbol positions upon which the reel stops, after it is rotated, may be unevenly spaced such that the stopping positions either side of the symbol position are spaced further from the symbol position than are adjacent stopping positions associated with blank portions of the reel. The present invention permits the area occupied by the symbols on the Keno reel (typically "bar" symbols) to be two or three times their present size with the intervening blanks correspondingly smaller.

As it is usual to have several blank symbols joining each other between each bar symbol, and as there is usually no dividing line between adjacent symbols, it would not be obvious, to players of the machine that the different symbols were allocated different proportions of the circumference of the reel and therefore the invention would not provide any visually disturbing effect when applied to Keno machines. Further, any apparent abnormality in the display when applied to normal poker machines would also be minimal.

Stepping motor driven poker machines using a 200 pulse per revolution motor, and equipped with reels in accordance with the present invention, can be operated with 20, 21, 22, 23 or even 26 symbol reels instead of the typical 25 symbol reels presently used.

In some cases, where a large symbol is displayed in the position adjacent to the centre-line, some proportion of that symbol may be obscured from view if the player does not adjust his viewing position, however, this is not considered to be a significant disadvantage. Also, in those cases where the symbol adjacent to the symbol of the centre-line is smaller than the nominal symbol height, a small portion of the next symbol may also be visible.

Embodiments of the invention will now be described, by way of example, with reference to the accompanying drawings in which.

Figure 6:
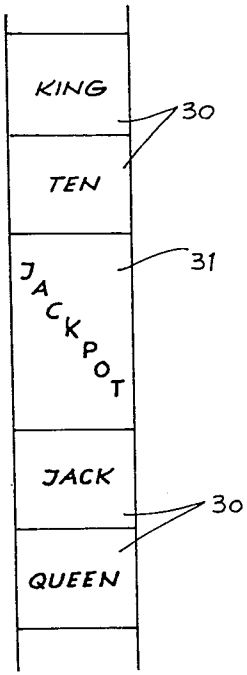
FIG. 6 illustrates a portion of a 24 symbol reel strip for a non stepping motor driven machine, in which one symbol position ("JACKPOT") occupies twice the space of the remainder of the symbols on the strip.
Figure 9:
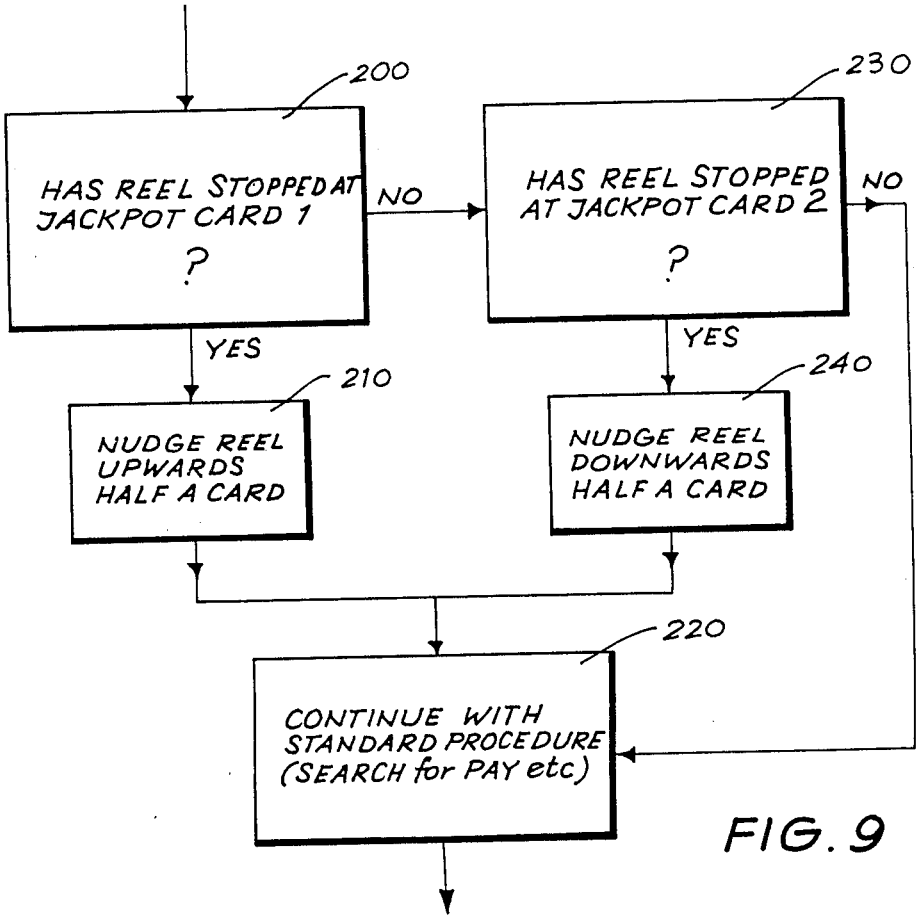
Figure 10:
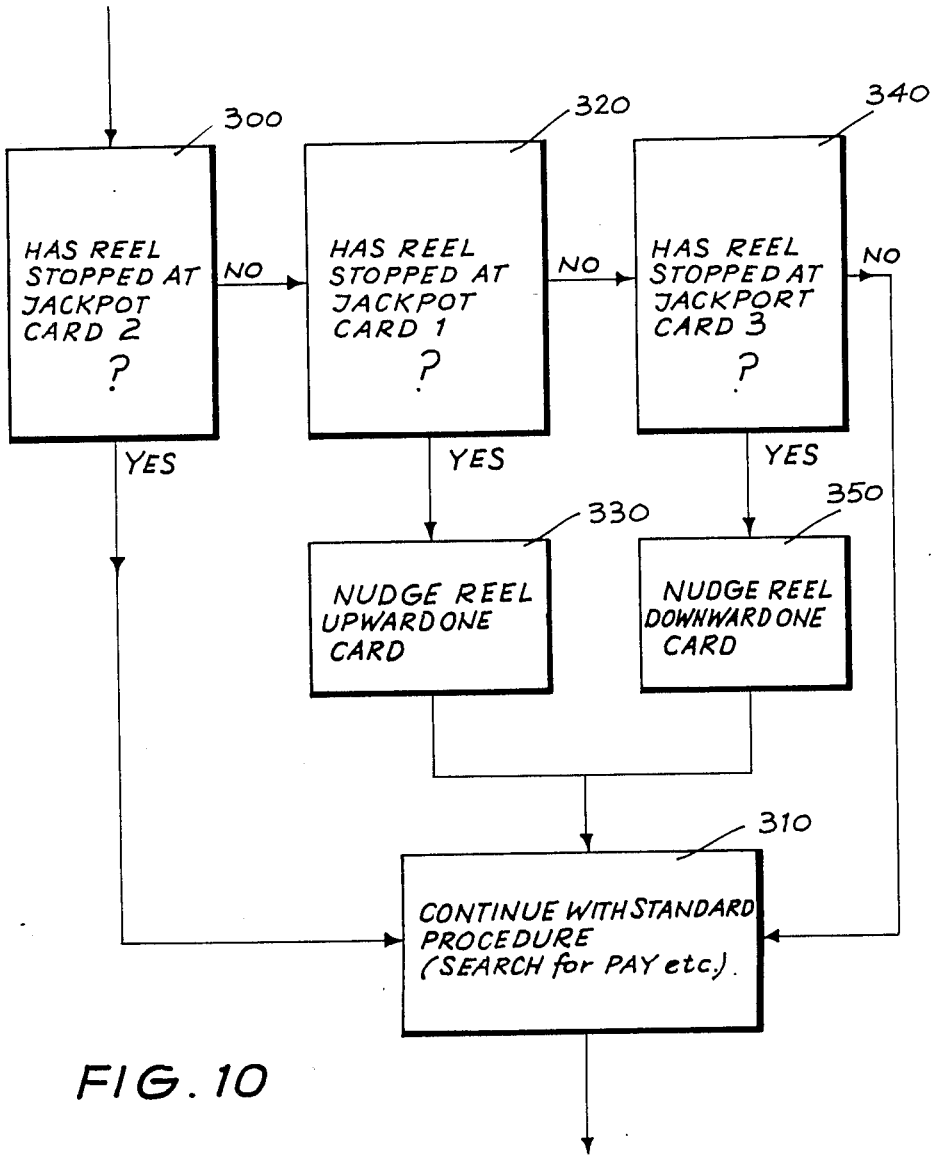

FIG. 9 illustrates a portion of a flow chart for a machine using the reel strip of FIG. 6, showing the programme sequence required to test for the occurrence of the double sized symbol on the centre line and to nudge the reel forward or backward one half card if necessary to centralize the double sized symbol; and FIG. 10 illustrates a portion of a flow chart similar to that of FIG. 9, for a machine fitted with a reel strip provided with a triple sized symbol, the flow chart showing the programme sequence required to test for the triple sized symbol on the centre line and to nudge the symbol backward or forward by one card if necessary to centre the triple sized symbol.

Figure 11:
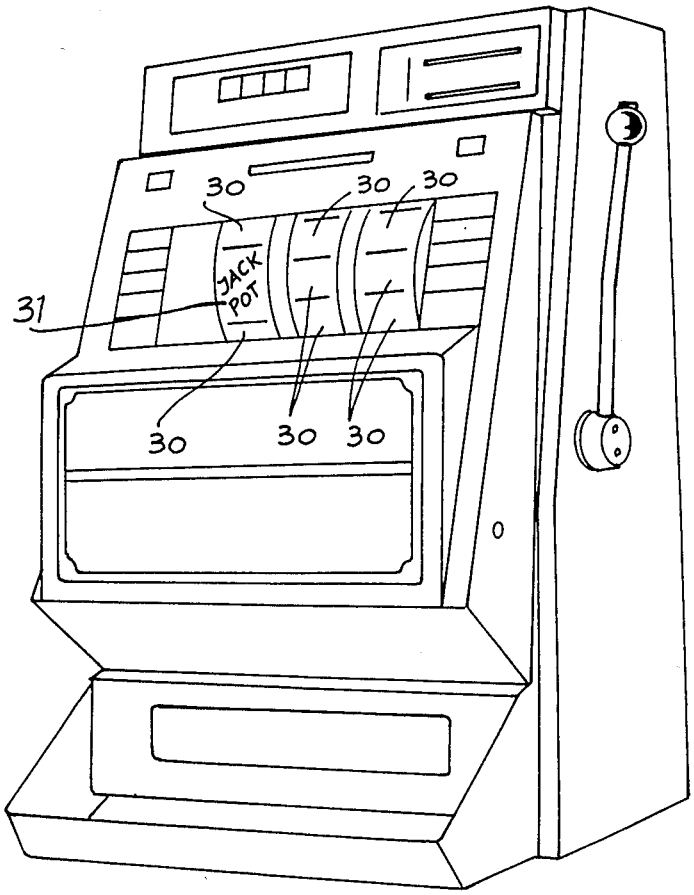

FIG. 11 illustrates a poker machine incorporating the reels made in accordance with the present invention.

Figure 1:
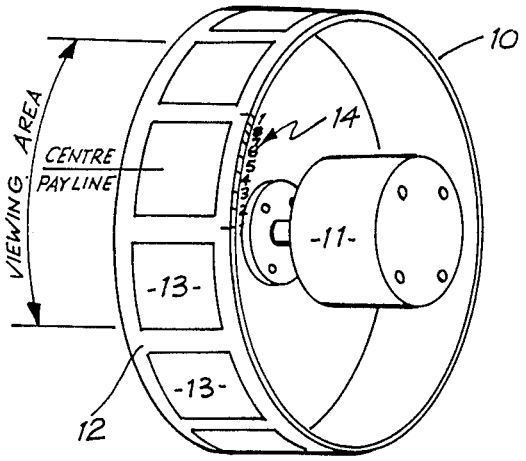
FIG. 1 PRIOR ART
FIG. 1 illustrates a typical prior art machine having 25 equally sized symbol spaces.

Referring now to FIG. 1, a typical reel 10 of a prior art stepper motor driven poker machine having a 200 pulse per revolution stepper motor 11 is illustrated. The reel strip 12 of the prior art reel has 25 equally sized symbols 13 located about its periphery and the usual viewing area through which three adjacent symbols may be viewed is indicated. Markings 14 have been superimposed on the edge of the reel to indicate the 8 pulses which are applied to the motor to move the reel by one symbol position or 1/25th of a revolution.

Figure 2:
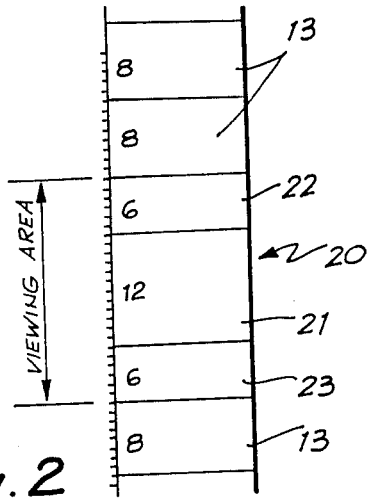
FIG. 2 illustrates a portion of a 25 symbol reel strip, for use in a stepping motor driven machine, in which the spaces allocated to the symbols are not all equal.

Referring now to FIG. 2, a reel strip 20 for a stepping motor machine according to the present invention is illustrated wherein not all of the symbol positions 13 are of equal size and in this example the symbol sizes are allocated as follows:

| | | | |
|---|---|---|---|
| 1 symbol @ | 12 pulses = | 12 | |
| 2 symbols @ | 6 pulses = | 12 | |
| 22 symbols @ | 8 pulses = | 176 | |
| 25 symbols | | 200 pulses = 1 revolution | |

The reel strip is shown stopped in a position with the featured symbol 21, which has a height of 12 pulses located in the centre of the viewing area. In this case each of the adjoining symbols 22, 23 exactly fit into the viewing space.

Figure 3:
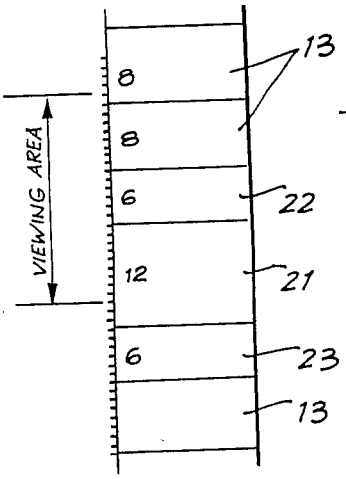
FIG. 3 illustrates the portion of the symbol strip of FIG. 2 when moved down one symbol position relative to the viewing window.

In FIG. 3, the same reel strip is illustrated when stopped one symbol lower giving the worst viewing condition. In this case one of the smallest symbols is exactly in the centre position, with the card above in full view and a fraction of the next card showing. The large card below centre is partly obscured unless the player moves his viewing position slightly.

Figure 4:
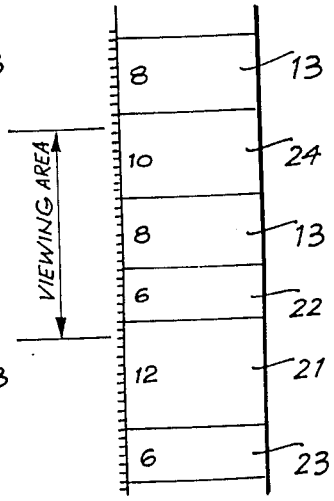
FIG. 4 illustrates a portion of a symbol strip having 23 symbols.

The portion of a reel strip illustrated in FIG. 4 is devised to have a total of 23 symbols which typically comprise:

| | | | |
|---|---|---|---|
| 1 symbol @ | 12 pulses = | 12 | |
| 2 symbols @ | 6 pulses = | 12 | |
| 12 symbols @ | 8 pulses = | 96 | |
| 8 symbols @ | 10 pulses = | 80 | |
| 23 symbols | | 200 pulses = 1 revolution | |

When this reel strip is moved upward by two symbols, to show the 12 pulse feature symbol 21 on the centre line, the display will be identical to that of FIG. 2.

Other reel combinations having a set of indicia which is not an integral sub-multiple of the number of pulses per revolution may be devised and some examples of these are set out below:

| | | | |
|---|---|---|---|
| 21 Symbols | | | |
| 1 symbol @ | 12 pulses = | 12 | |
| 2 symbols @ | 6 pulses = | 12 | |
| 2 symbols @ | 8 pulses = | 16 | |
| 16 symbols @ | 10 pulses = | 160 | |
| 21 symbols | | 200 pulses | |
| 22 Symbols | | | |
| 1 symbol @ | 12 pulses = | 12 | |
| 2 symbols @ | 6 pulses = | 12 | |

-continued

| | | | |
|---|---|---|---|
| 7 symbols @ | 8 pulses = | 56 | |
| 12 symbols @ | 10 pulses = | 120 | |
| 22 symbols | | 200 pulses | |

Typically in prior art poker machines employing stepping motors 11 to drive the reels 10, the stopping position of the reel is determined by randomly selecting the symbol number of the symbol upon which the reel is to stop and then, having stepped the reel to the index position, the reel is stepped on by a number of steps equal to the symbol number multiplied by the number of motor pulses per symbol. Clearly, this technique must be modified slightly in order to allow for the unequal symbol sizes of the reel of the present invention. However, a relatively simple modification to the typical control scheme is all that is required in order to accommodate reels in accordance with the present invention.

Figure 5:
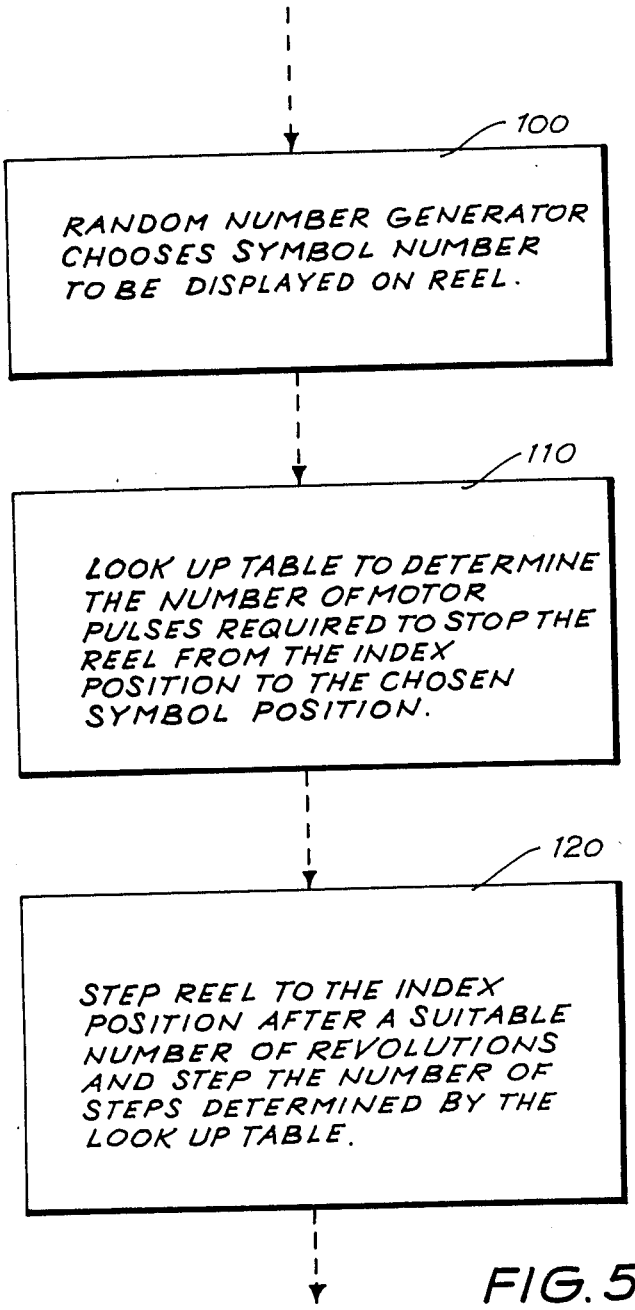
FIG. 5 illustrates a portion of a flow chart indicating the manner in which control of the stepping motor would be implemented in a typical poker machine control programme.

Referring to FIG. 5, a portion of a flow chart describing the control programme of a poker machine, in which the dashed arrows represent portions of an existing poker machine control programme which are not described here. The block labelled 100 represents the random selection of a symbol upon which the particular reel is to be stopped, this being a pre-existing step in the control programme of many poker machines. In poker machines using reels in accordance with the present invention, an additional step 110 is inserted after the random selection step 100 of the prior art machine, the step 110 being used to look up a look up table which gives the reel stopping position for each symbol on the reel relative to the index position, in terms of the number of motor pulses required to step the reel from the index position to the selected symbol. Finally, in the motor control portion of the poker machine control programme, the motor is controlled to first provide a number of revolutions of the reel and then finally to step to the index position and execute a number of steps equal to the number looked up in the look up table. This programme step indicated as item 120 would replace the prior art procedure of stepping on from the index position by a number of steps equal to the symbol number multiplied by the number of steps per symbol.

Referring to FIGS. 6–10, conventional poker machines with the free spinning reels are generally provided with stopping mechanisms which allow the reels to be stopped at half card or full card intervals, where a card 30 is the standard division of the circumference of the reel and typically there are 25 cards to a reel. In such machines it is possible to implement the present invention by using symbol areas which are multiples (eg. 2x or 3x) the standard card such as with the "JACKPOT" symbol 31 of FIGS. 6, 7 and 8.

Figure 7:
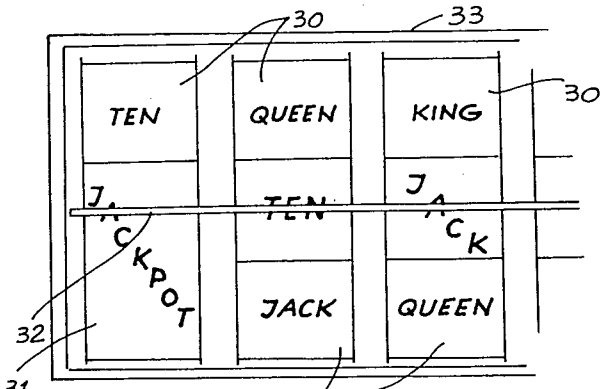
FIG. 7 illustrates a poker machine window having a reel in the first position which is fitted with a reel strip similar to that of FIG. 6.
Figure 8:
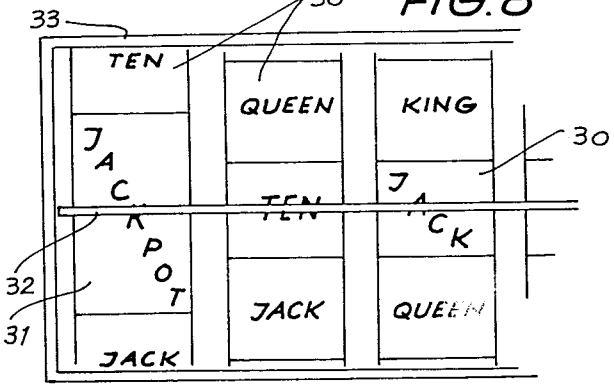
FIG. 8 illustrates the window of FIG. 7 with the first reel "nudged" up by one half symbol to centre the double sized "JACKPOT" symbol.

When multiple card symbols 31 are used, however, it becomes necessary to test the reel when stopped, to determine whether a large card is in the centre line 32 of the window 33 and if so whether it is centred on the centre line 32. In the case of a double sized card 31, as illustrated in FIGS. 6, 7 and 8, it will be necessary to nudge the card forward or backward by half a card, if the large symbol is not centred on the centre line 32. The technique of nudging is well known and understood and a variety of prior art machines have been produced in which the reels could be nudged forward or backward by one or more positions, for various purposes, and an explanation of the mechanism used will not be given here.

Referring to FIG. 9, centering of the double sized symbol of FIGS. 6–8 is achieved by first testing (200) to see if the reel has stopped on the first half of the double sized card, and if so causing the reel to be nudged upward (210) by one half card and then continuing (220) with the standard procedure. If the reel had not stopped on the first half of the double sized card, the programme would then test (230) to see if the reel had stopped on the second half of the double sized card and if so the reel would be caused to be nudged downward (240) by half a card, before continuing (220) with the standard procedure. Alternatively, if the reel had not stopped on either half of the double sized card, the programme would simply continue (220) with its standard procedure.

It is also possible to use reel strips using triple sized symbols (not shown), in which case it will be necessary under some circumstances to nudge the reel forward or backward by a full card position. Referring to FIG. 10, the flow chart for a symbol centering routine for a machine with a triple sized symbol is illustrated, from which it will be seen that once the reel has stopped spinning, the reel is tested (300) to determine whether it has stopped with the central portion of the triple sized symbol on the centre line, in which case standard processing will be continued (310). If the reel had not stopped on the central portion of the large symbol, a test is performed (320) to determine whether the reel has stopped on the first portion of the large symbol, in which case the reel will be nudged upward (330) by one card and standard processing continued (310). Finally, if the reel has not stopped on the first or second cards of the large symbol, a test is performed (340) to determine if the reel has stopped on the third card of the large symbol in which case the reel will nudge downward (350) by one card before standard processing is continued (310). Alternatively, if the reel has not stopped with any cards of the triple sized symbol on the centre line, no nudging will take place and standard processing will continue (310).

It will be recognised by persons skilled in the art that numerous variations and modifications may be made to the invention as described above without departing from the spirit or scope of the invention as broadly described.

We claim:

1. A reel for a slot machine display, said reel including a cylindrical peripheral surface to which a plurality of indicia are applied, each of said indicia having a symbol space within which the indicia is substantially centrally located, said symbol spaces occupying a proportion of the circumference of the cylindrical surface which is different for different indicia on said surface, a majority of the indicia on said reel having symbol spaces of uniform size and the remainder of the indicia having a symbol space which differs from the uniform size by an amount which is a fraction of the uniform size, said remainder of the indicia being divided into two groups, one consisting of indicia having symbol-spaces occupying a proportion of said circumference which is greater than that of said majority and the other consisting of indicia having symbol spaces occupying a proportion of said circumference which is less than that of said majority.

2. The reel for a slot machine as claimed in claim 1 wherein the symbol space of each of the remainder of the indicia occupies a proportion of the circumference in the range of one half to one and one half times that of the majority of the indicia.

3. The reel according to claim 1, in which the total number of symbol spaces is 25, of which 22 are of uniform size, one is 1.5 times uniform size, and two are 0.75 times uniform size.

4. The reel according to claim 1, in which the total number of symbol spaces is 23, of which 12 are of uniform size, one is 1.5 times uniform size, and two are 0.75 times uniform size and eight are 1.25 times uniform size.

5. The reel according to claim 1, in which the total number of symbol spaces is 21, of which 16 are of uniform size, one is 1.2 times uniform size, and two are 0.6 times uniform size and two are 0.8 times uniform size.

6. The reel according to claim 1, in which the total number of symbol spaces is 22, of which 12 are of uniform size, one is 1.2 times uniform size, and two are 0.6 times uniform size and seven are 0.8 times uniform size.

7. A slot machine including one or more display reels, each of said reels including a cylindrical peripheral surface to which a plurality of indicia are applied, each of said indicia having a symbol space within which the indicia is substantially centrally located, said symbol spaces occupying a proportion of the circumference of the cylindrical surface which is different from different indicia on said surface, a majority of the indicia on each said reel having symbol spaces of uniform size and the remainder of the indicia on each respective reel having a symbol space which differs from the uniform size by an amount which is a fraction of the uniform size, said remainder of the indicia being divided into two groups, one consisting of indicia having symbol spaces occupying a proportion of said circumference which is greater than that of said majority and the other consisting of indicia having symbol spaces occupying a proportion of said circumference which is less than that of said majority.

8. The slot machine of claim 7 wherein a look up table is provided in which are stored the number of motor steps corresponding to each symbol space on the reels, the look up table being used to calculate the correct number of steps required to stop a reel with any given symbol centered on a display centre line.

9. The slot machine as claimed in claim 7 wherein the symbol space of each of the remainder of the indicia occupies a proportion of the circumference in the range of one half to one and one half times that of the majority of the indicia.

10. The slot machine as claimed in claim 7 wherein each of said reels is driven by a stepping motor and each of the symbol spaces occupies a proportion of the circumference of its respective reel which is a multiple of the incremental rotational step size of the respective stepping motor.

11. The reel according to claim 7, in which the total number of symbol spaces is 25, of which 22 are of uniform size, one is 1.5 times uniform size, and two are 0.75 times uniform size.

12. The reel according to claim 7, in which the total number of symbol spaces is 23, of which 12 are of uniform size, one is 1.5 times uniform size, and two are 0.75 times uniform size and eight are 1.25 times uniform size.

13. The reel according to claim 7, in which the total number of symbol spaces is 21, of which 16 are of uniform size, one is 1.2 times uniform size, and two are 0.6 times uniform size and two are 0.8 times uniform size.

14. The reel according to claim 7, in which the total number of symbol spaces is 22, of which 12 are of uniform size, one is 1.2 times uniform size, and two are 0.6 times uniform size and seven are 0.8 times uniform size.

* * * * *